United States Patent [19]

Atago et al.

[11] Patent Number: 4,474,151

[45] Date of Patent: Oct. 2, 1984

[54] ENGINE REVOLUTION SPEED CONTROL DEVICE

[75] Inventors: Takeshi Atago; Toshio Manaka, both of Katsuta, Japan

[73] Assignee: Hitachi, Ltd., Tokyo, Japan

[21] Appl. No.: 347,246

[22] Filed: Feb. 9, 1982

[30] Foreign Application Priority Data

Feb. 10, 1981 [JP] Japan ..... 56-17470

[51] Int. Cl.[3] ..... F02D 1/04; F02D 1/06

[52] U.S. Cl. ..... 123/339; 123/328; 123/340

[58] Field of Search ..... 123/339, 340, 341, 328, 123/179 G; 364/431, 424, 442

[56] References Cited

U.S. PATENT DOCUMENTS

| | | | |
|---|---|---|---|
| 3,621,824 | 11/1971 | Burnia et al. | 123/328 |
| 3,645,241 | 2/1972 | Huntzinger | 123/328 |
| 3,691,873 | 9/1972 | Lombard et al. | 123/328 |
| 3,766,367 | 10/1973 | Sumiyoshi et al. | 123/340 |
| 3,964,457 | 6/1976 | Coscia | 123/339 |
| 4,060,063 | 11/1977 | Hirasawa | 123/328 |
| 4,203,395 | 5/1980 | Cromas et al. | 123/339 |
| 4,244,023 | 1/1981 | Johnson | 123/340 |
| 4,351,296 | 9/1982 | Kayanuma | 123/328 |
| 4,365,601 | 12/1982 | Yamazae et al. | 123/340 |
| 4,380,979 | 4/1983 | Takase | 123/340 |

*Primary Examiner*—Raymond A. Nelli

*Attorney, Agent, or Firm*—Antonelli, Terry & Wands

[57] ABSTRACT

An engine revolution speed control device includes sensors (8, 9, 10) for detecting parameters representing the engine conditions, an actuator (7) for controlling the reset position of the throttle (13), a switch (11) producing a signal when the throttle action returns under the control of the actuator (7) and a device (12) which is cyclically driven under the condition that no signal from the switch (11) exits. The device (12) takes in one of the data from the sensors (8, 9, 10) and operates the actuator (7) by a predetermined amount in such a direction as to close the reset opening of the throttle every time that the amount of variation in the data taken in reaches a predetermined value.

6 Claims, 15 Drawing Figures

FIG. 6A.
FIG. 6B.
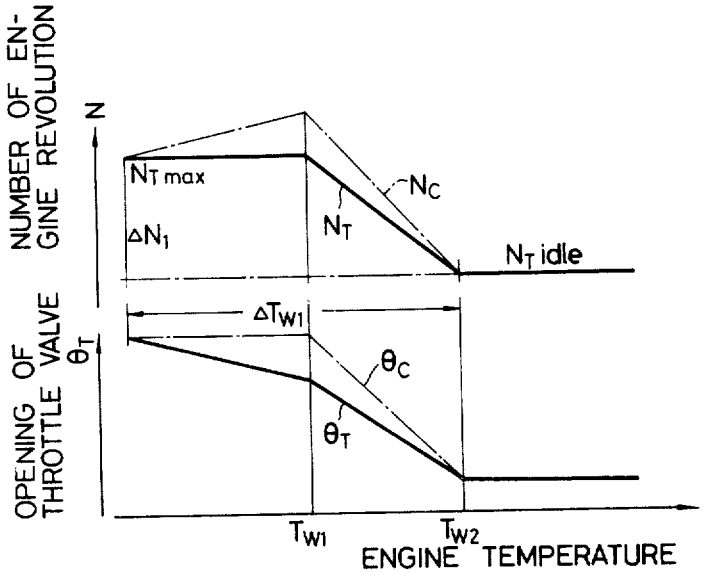
FIG. 7.
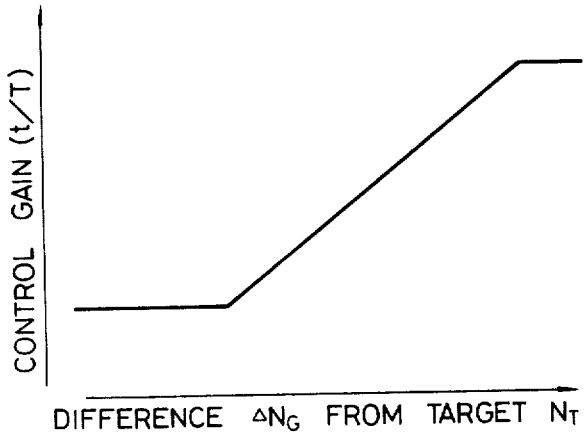

VEHICLE SPEED
0
IDLING
G
ACCELERATION
H
IDLING

TEMPERA-TURE
$T_W$
$T_{WG}$

NUMBER OF ENGINE RE-VOLUTION
$N_A$
$N'_A$
$N_P$
$N'_A$
$N'_B$
$N_B$
$N_T$ idle

ACTURATOR POSITION
ON
OFF
$C_{SW}$

THROTTLE OPENING
$\theta_{TR}$
$P_{AC}$
$\theta_{TR'}$
$\Delta D_B$
$\theta_{TR''}$
$P'_{AC}$
$\Delta T_W$

PULSE B
TIME

ENGINE REVOLUTION SPEED CONTROL DEVICE

BACKGROUND OF THE INVENTION

This invention relates to the automotive engine revolution speed control device which prevents an abnormal increase in engine revolution when the engine returns from the accelerated condition to the idling condition.

In the conventional automotive gasoline engines, various control functions on the engine, such as an air-fuel ratio control according to the accelerator opening and the load torque, a starting and warm-up adjustment and an idling control, have been done almost solely by the carburetor.

In recent years, however, an electronic engine control system has become widely used, in which various data representing engine running condition is read in using microcomputer so that the engine running condition is controlled comprehensively through various kinds of actuators.

One of the known idling control devices has an actuator to feed-back control the throttle valve opening during idling according to the data from the engine temperature sensor and engine revolution sensor so as to control the engine revolution speed during warm-up (FISC) and the engine revolution speed during idling (ISC).

With this kind of electronic revolution control device, however, the engine revolution is controlled only when the idling detection switch is turned on, so that there is a drawback that when the engine, after being accelerated during warm-up, is returned to the idling condition, the engine revolution will abnormally increases.

SUMMARY OF THE INVENTION

The object of this invention is to provide an engine revolution control device which overcomes the above drawback and which prevents an abnormally high increase in engine revolution when the engine returns to the idling condition after being accelerated during warm-up.

To achieve this objective, the present invention is characterized by the fact that the throttle opening is controlled in accordance with the engine temperature when it is not under the control of the throttle actuator.

BRIEF DESCRIPTION OF THE DRAWINGS

FIG. 4, 5, 6A, 6B, 7 and 8A through F are characteristic diagrams presented for explaining the action of the device.

DESCRIPTION OF THE PREFERRED EMBODIMENT

Figure 1:
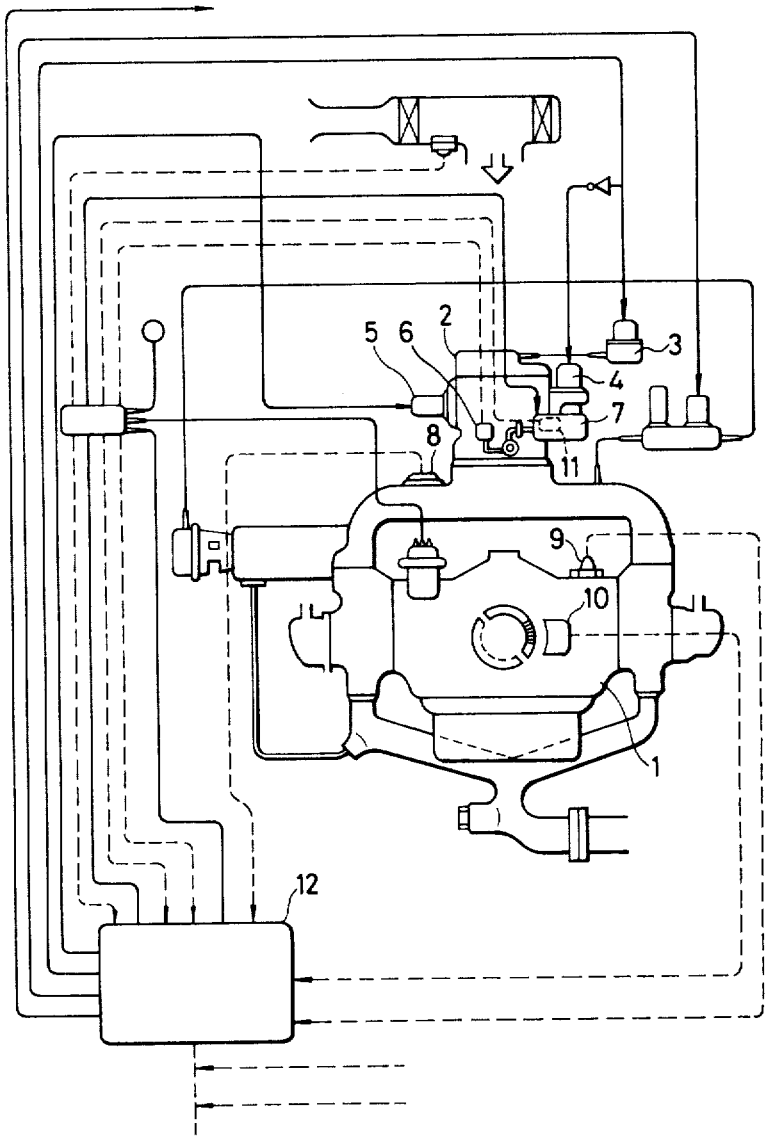
FIG. 1 is a block diagram showing one example of the electronic engine control system to which the present invention is applied.

In FIG. 1, an engine 1 is provided with a intake manifold vacuum sensor 8, a cooling water temperature sensor 9, and a pulse type engine revolution sensor 10. A carburetor 2 includes a slow solenoid 3, a main solenoid 4, a fuel solenoid 5, a limit switch 6 and a throttle actuator 7. A control unit 12 controls the engine in response to output signal from the sensors 8, 9, 10.

Figure 2:
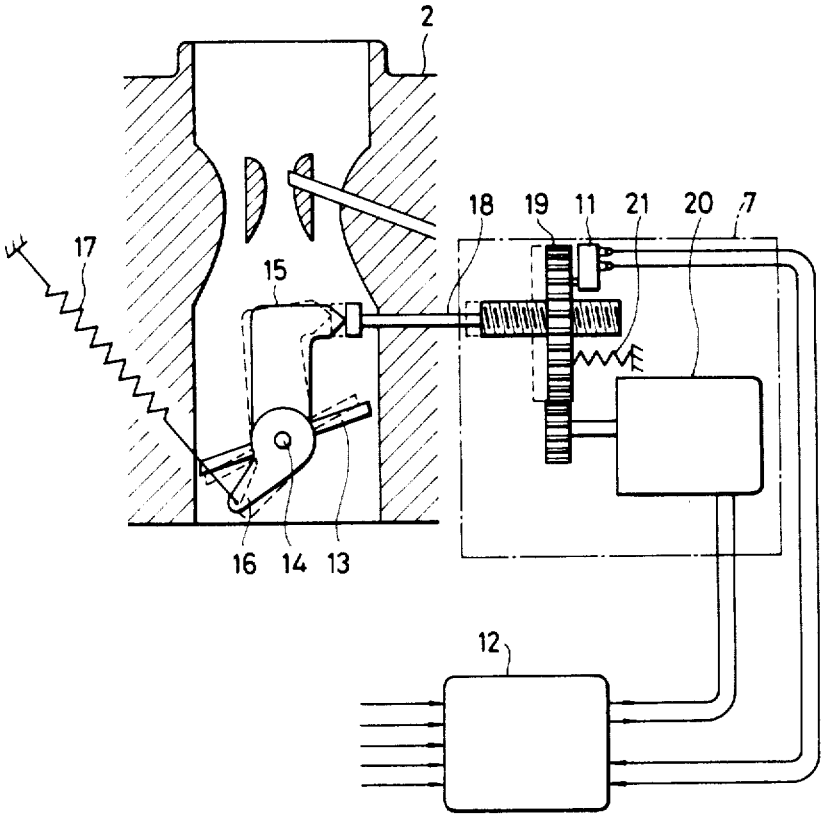
FIG. 2 is a simplified view of the throttle actuator.

In FIG. 2, the carburetor 2 and the throttle actuator 7 are shown in detail. A throttle valve 13 pivotally mounted by a shaft 14, is opened or closed by an open-close lever 15 attached to the shaft 14, a return lever 16 and a return spring 17. The throttle actuator 7 comprises a stroke shaft 18, a reduction gear 19, a direct current motor 20 and a spring 21.

When the accelerator is not depressed, the throttle valve 13 is returned to the reset position by the tension of the return spring 17. The reset position is the position wherein the open-close lever 15 abuts against the stroke shaft 18. The stroke shaft 18 is engaged with the gear 19 through threads, so that the reset position of the throttle valve 13 can be controlled by sending a signal to the motor 20 to rotate the gear 19.

The stroke shaft 18 and the gear 19 are so constructed as to be slightly movable along the length of the shaft 18. When the accelerator is depressed and the throttle valve 13 is opened from the reset position, the assembly of the stroke shaft 18 and gear 19 is shifted by the spring 11, to the left to the dotted line position to open the switch 11. When the throttle valve 13 is returned to the reset position by the tension of the return spring 17, the open-close lever 15 is pressed against the stroke shaft 18, compressing the spring 21 and closing the switch 11. Thus, it is possible to detect by the switch 11 whether the throttle valve 13 is being operated or is in the return position.

When the throttle valve 13 is returned to a position near to the fully closed position, the limit switch 6 will operate. Operation of the limit switch 6 indicates that the throttle valve 13 has come near to the fully closed position. The limit switch 6 also serves as a stopper that determines the fully reset position of the throttle valve 13.

Figure 3:
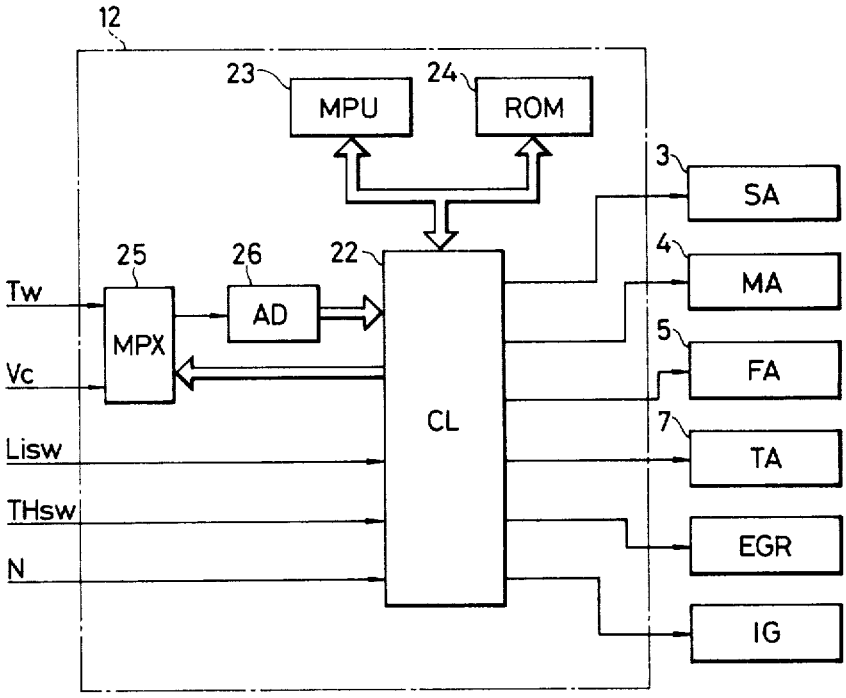
FIG. 3 is a block diagram of control unit.

As shown in FIG. 3 the control unit 12 comprises a control logic 22, a microprocessor 23, a ROM 24, a multiplexer 25, and an analog-digital converter 26. The analog data such as the suction vacuum Vc from the negative pressure sensor 8 (FIG. 1) and the engine temperature Tw from the water temperature sensor 9 are inputted to the control logic 22 through the multiplexer 25 and the analog-digital converter 26, while the digital data such as the data THsw from the idling detection switch 11 and the engine revolution N from the revolution sensor 10 are inputted directly to the control logic 22. These data accepted by the control logic 22 are processed by the microprocessor 23 and the ROM 24 to control the various actuators such as slow solenoid 3, main solenoid 4, fuel solenoid 5 and throttle actuator 7 so as to perform optimum control in accordance with the operating condition of the engine.

Thus, with the system constructed as above, during the normal running condition it is possible to control the air-fuel ratio at optimum value by controlling the main and slow solenoids 3 and 4 according to various data representing the engine operating condition. During the warming up of the engine, the air-fuel ratio is controlled at the optimum value by controlling the fuel solenoid 5. By controlling the throttle actuator 7, it is possible to control the engine revolution at optimum value during idling and warming up condition.

Figure 4:
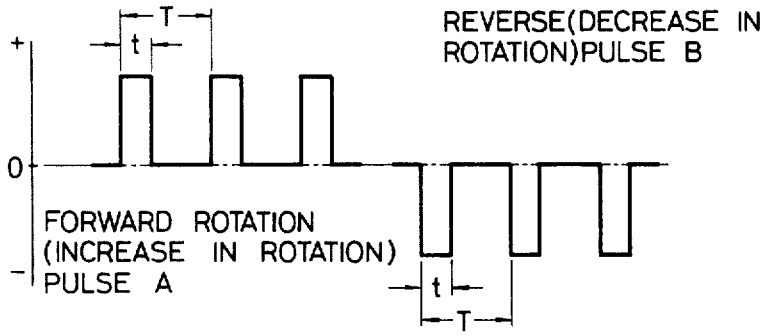

The throttle actuator 7 is digitally controlled by the control unit 12, i.e., the DC motor 20 is driven pulses to advance or retract the stroke shaft 18 thereby adjusting the reset position of the throttle valve 13. The waveform of a pulses supplied to the DC motor 20 is shown in FIG. 4. The pulse has a width t recurring at intervals T. Thus, when the pulse is supplied to the motor 20, the number of engine revolutions obtained by supplying a single pulse will be a constant value and the amount of movement of the stroke shaft 18 can be determined by the number of pulses supplied.

The position of the stroke shaft 18 determines the reset position of the throttle valve 13, i.e., the opening of the throttle valve 13 during idling, which, in turn, determines the engine revolution. Therefore, the engine revolution can be controlled, as shown in FIG. 5, by the number of pulses supplied to the DC motor 20 of the throttle actuator 7.

Figure 5:
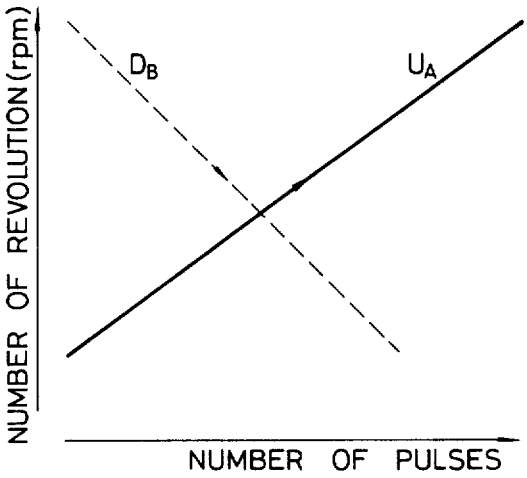

In FIG. 5, the line UA represents the characteristic obtained when positive pulses are applied and the line DB represents the characteristic when negative pulses are applied.

In the electronic control system described above, when the idling detection switch 11 is turned on and detects that the throttle valve 13 assumes the idling position, the control unit 12 performs a sequence of functions, i.e., adding the FISC or ISC program to the microcomputer program according to the data Tw from the water temperature sensor 9, taking in the data N from the engine revolution sensor 10, and controlling the throttle actuator 7 so that the engine revolution will be equal to the target FISC revolution speed or the target idling revolution speed as determined by the data Tw from the water temperature sensor 9 and, in this manner, the FISC or ISC control is performed.

In the throttle valve opening control action by the throttle actuator 7, there is a kind of hysteresis observed due to the effect of the return spring 17. As is apparent from FIG. 5, a change in engine revolution brought about by the pulse A is generally greater than the change by the pulse B.

The cycle T and the pulse width t of the pulse A or B constitutes the elements that determine the rotating angle of the motor 20 for each pulse. The ratio t/T is called a control gain and, as the gain becomes larger, the response speed of the throttle actuator 7 will be higher.

The FISC characteristic in the electronic engine control system usually is determined as shown in FIGS. 6A and 6B and, as shown in FIG. 6A, the engine revolution N is controlled so as to be equal to the characteristic $N_T$ which is a function of the engine temperature $T_W$ (equal to the data from the water temperature sensor 9).

The control target revolution speed $N_T$ changes with the temperature $T_W$ and, for a temperature less than $T_{W1}$, for example 5° C., the target revolution becomes $N_{Tmax}$ and, for a temperature higher than $T_{W2}$ at the completion of warming up, becomes the idling revolution $N_{Tidle}$. For the intermediate temperatures, the target revolution number $N_T$ varies from $N_{Tmax}$ to $N_{Tidle}$.

FIG. 6B shows the throttle opening $\theta_T$ which is required to produce the engine revolution equal to the target value. A loss due to engine friction reduces with an increase in temperature so that although the target revolution $N_T$ is constant at $N_{Tmax}$ for the temperature below $T_{W1}$, the throttle opening $\theta_T$ is not constant for the temperature below $T_{W1}$ but varies with the temperature. Thus, if the throttle opening $\theta_T$ is controlled as shown by the line $\theta_C$, the engine revolution number N follows the line $N_C$ (in FIG. 6A).

FIG. 7 shows one example of setting the control gain t/T in relation with a difference $N_G$ from the target revolution number $N_T$, with the value of the control gain t/T being determined by a transition response and stability of the engine revolution control system. Theoretically, the setting of gain should be accomplished in such a manner that the gain t/T becomes large as the difference between the target revolution number $N_T$ and the actual revolution number N increases. In practice for example, about 50 rpm/second is usually selected with greater significance being placed on the stability. Because of this, when the difference between N and $N_T$ is large, it will take a resonably long period of time before the target revolution $N_T$ is reached thus greatly reducing the driving performance. Therefore, when starting the revolution control by the throttle actuator 7, the throttle actuator 7 must be positioned as near to that throttle opening corresponding to the target or desired revolution as possible.

Figure 9:
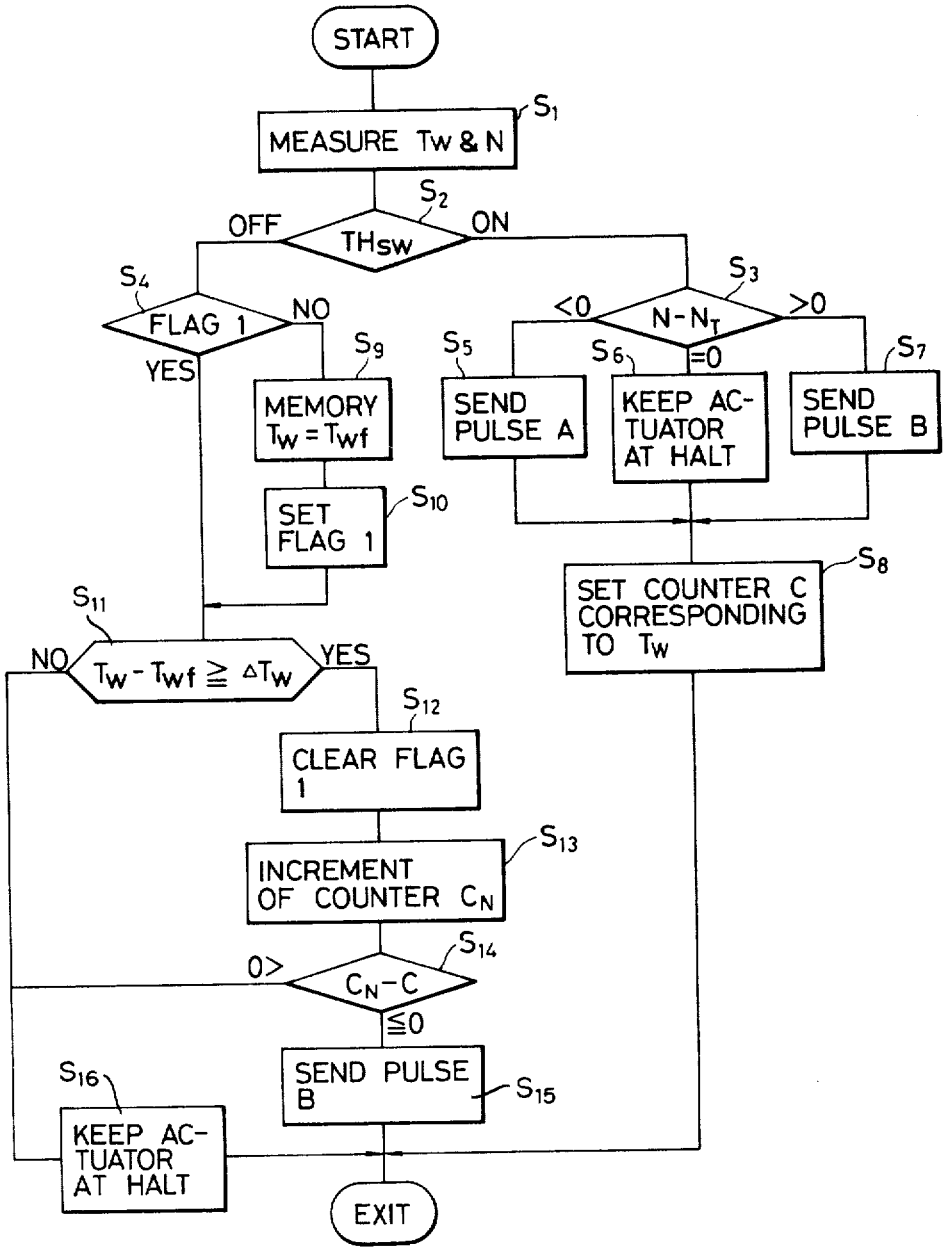
FIG. 9 is a flowchart for explaining a sequence of action of one embodiment of this invention.

As shown in FIG. 9, when the program begins to be executed, at the first step $S_1$ the program takes in the water temperature data $T_W$ from sensor 9 and the revolution data N from the sensor 10. At the second step $S_2$, the program it checks the data $TH_{SW}$ from the idling detection switch 11 to see if the switch is on or off. When the idling detection switch 11 is recognized as being in an on position, the program proceeds to step 3 $S_3$ and when off proceeds to step 4 $S_4$.

If at step two $S_2$ the switch 11 is found to be on, the program goes to step 3 $S_3$ where it checks the difference $(N-N_T)$ between the actual revolution N from the engine revolution sensor 10 and the target revolution $N_T$ or the target idling revolution speed which is a function of the temperature $T_W$ as shown in FIG. 6A. If the difference $(N-N_T)$ is found to be less than 0, the program proceeds to step 5 $S_5$ and sends a forward rotation pulse A to the actuator 7. If the difference is found to be $=0$, it goes to step 6 $S_6$ and keeps throttle actuator 7 at halt, i.e., it does not supply pulse signals. If the difference is found to be greater than 0, the program proceeds to step 7 $S_7$ and supplies a reverse rotation pulse B to the throttle actuator 7.

After processing one of the steps $S_5$, $S_6$ and $S_7$, the program goes to $S_8$ and then to step eight the EXIT. At step $S_8$ the program sets in the counter the count data corresponding to the water temperature data $T_W$.

In this way, according to the decision at step $S_3$ one of the steps $S_5 \sim S_7$ is performed. This in turn changes the throttle opening $\theta_T$ as shown in FIG. 6B and controls the engine revolution N to the target revolution $N_T$ of FISC and the target idling revolution $N_{Tidle}$, as shown in FIG. 6A, thus performing the FISC and ISC functions.

At step $S_2$, if by checking the data $TH_{SW}$ the idling detection switch 11 is found to be off, the program goes to step $S_4$ and checks if the flag 1 is set. When the flag 1 is recognized as set, the program goes directly to step 11 $S_{11}$. When the flag 1 is recognized as not set, the program goes to step 9 $S_9$ where it stores the water temperature data $T_W$ in memory as the data $T_{Wf}$ and then it goes to step 10 $S_{10}$ where it sets the flag 1, after which it goes to step $S_{11}$.

At step $S_{11}$ it is checked whether the difference between the water temperature data $T_W$ and the other water temperature data $T_{Wf}$ stored in memory is larger than a predetermined value. If the difference is larger than or equal to $\Delta T_W$, the program goes to step twelve $S_{12}$ where it clears the flag 1, and then further proceeds to $S_{13}$ step increment the counter $C_N$.

At step fourteen $S_{14}$ the difference ($C_N - C$) between the data of counter $C_N$ and the data of counter C is checked. If it is found to be $\geqq 0$, the program proceeds to step fifteen $S_{15}$ where it gives a single reverse rotation pulse B to the actuator 7, before going to the EXIT. When it is found to be less than 0, the program goes to step sixteen $S_{16}$ leaving the throttle actuator 7 at halt before going out to the EXIT.

Figures 8A, 8B, 8C, 8D, 8E, 8F:
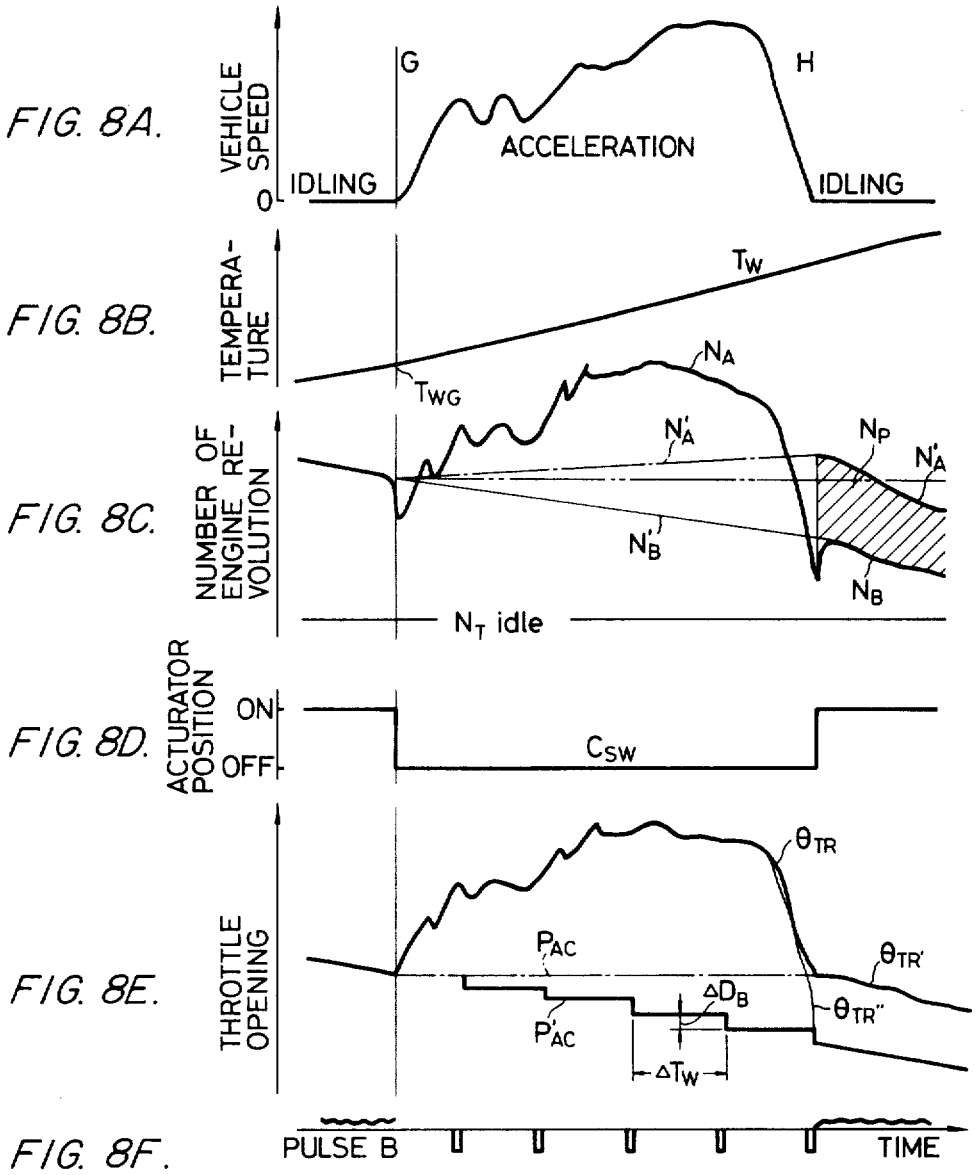

At $S_{11}$ if the result is NO, the program also passes $S_{16}$ to the EXIT terminating its control sequence. When the flow of control sequence from steps $S_4$ and $S_9$ through step $S_{16}$ is executed, a single reverse pulse B is supplied, as shown in FIG. 8F, to the throttle actuator 7 each time the water temperature $T_W$, shown in FIG. 8B changes by the predetermined value $T_W$ after the point G, thereby resulting in the throttle reset control position $P_{AC}$ changes its position to the $P_{AC'}$ in FIG. 8E. As a result, in the period between G and H the reset opening of the throttle 13 is controlled in the manner indicated by the line $\theta_T$ in FIG. 6B. At the point H, when the accelerator is released and the throttle valve 13 returns to the idling position, the opening varies from $\theta_{TR}$ to $\theta_{TR''}$ shown in FIG. 8E and the engine revolution also shifts from $N_A$ to $N_B$ shown FIG. 8C. In this manner, the revolution of the engine is prevented from becoming abnormally high when the engine returns to the idling condition.

If at this time the reset opening of the throttle valve 13 at the point H is too small, there is a possibility of engine being stalled; however, with the above embodiment, this can be prevented because at the step $S_8$ the count data C corresponding to the water temperature data $T_W$ at the point G is set and at step $S_{14}$ it is checked to determine whether the count data $C_N$ has reached the count data C, in order to limit, according to the water temperature $T_w$ at the point G, the maximum number of reverse pulses B supplied to the throttle actuator 7.

With the conventional electronic revolution control device, however, the engine revolution is controlled only when the idling detection switch 11 (FIGS. 1 and 2) is turned on, so that there is a drawback that when the engine, after being accelerated during warm-up, is returned to the idling condition, namely, the engine revolution will abnormally increases.

FIGS. 8A through E show the vehicle speed at 8A, temperature at 8B, engine revolution at 8C, on/off condition of the idling detection switch 11 at 8D, and the throttle opening at 8E controlled by the throttle actuator 7, when the engine is started at low temperatures and at the point G accelerated before the warm-up is completed and then returned to the idling condition.

Since the engine revolution speed control by the throttle actuator 7 is done effected only when the switch 11 is turned on, the throttle actuator 7 is fixed at a constant opening position $P_{AC}$ for the period between the points G and H, as shown in FIG. 8E.

As the engine continues running during this time, the temperature $T_W$ goes up from $T_{WG}$ at point G, as shown in FIG. 8B; therefore, if the control by throttle actuator 7 were accomplished during this time, the actual revolution N would go down according to the temperature $T_W$ and the characteristic would change from $N'_B$, to $N_B$ of FIG. 8C.

As described above, however, the throttle actuator 7 is maintained at the position $P_{AC}$ for the period between G and H. Thus, when the accelerator is released at the point H and the engine returns to the idling condition, the throttle opening returns from the opening $\theta_{TR}$ to that of the throttle actuator position $P_{AC}$ of FIG. 8E. After this, the throttle opening is controlled by FISC to $\theta'_{TR'}$, with the result being that the engine revolution changes at the point H from $N_A$ of FIG. 8C to the revolution $N'_A$, which corresponds to the throttle opening $P'_{AC}$, thus producing a difference $N_P$ between the actual revolution $N'_A$, and the revolution $N_B$ to which the FISC control is intended to control the engine revolution. This greatly increases the idling engine revolution and, if at this time the gain t/T of the FISC control system is sufficiently large, the transition of the engine revolution from $N_A$ to $N_B$ is effected comparatively quickly thereby giving rise to almost no serious problems. However explained hereinabove, as a practical matter the control gain t/T cannot be set at a large value. Therefore, the abnormally high revolution during idling continues for a reasonably long period, as shown cross-hatched area in FIG. 8C, deteriorating the driving performance.

As evident from the foregoing description, since with this invention the control of throttle actuator is performed even during idling so that the throttle actuator is set at the opening corresponding to the required idling revolution speed in accordance with the engine temperature, it is possible to provide an engine revolution control device which overcomes the conventional drawbacks and prevents the engine revolution from becoming abnormally high when the accelerator is released and the engine returns from the accelerated condition to the idling condition.

We claim:

1. An engine revolution speed control device for controlling a positioning of a throttle valve means of an internal combustion engine, the speed control device comprising: sensor means for detecting at least an operating temperature of the engine; an actuator means for controlling a reset position of the throttle valve means of the engine; a switch means for producing an idling signal when a throttle action of the throttle valve means returns under a control of the actuator means and for providing an acceleration signal when the throttle valve means is independent of the actuator means; and a means cyclically driven when the acceleration signal from the switch means is provided for receiving data from the sensor means, the cyclically driven means being adapted to operate the actuator means by a predetermined amount in a direction so as to reduce a reset opening of the throttle valve means each time an amount of variation in the data received reaches a predetermined value, whereby the reset opening of the throttle valve means is controlled in accordance with a running condition of the engine during an idling condition and the engine rotational speed is prevented from increasing when the engine returns from an accelerated condition to the idling condition.

2. An engine revolution speed control device as set forth in claim 1, wherein said cyclically driven means includes a memory means for storing the data from said sensor means each time the control action of the acutator means is initiated in response to the acceleration signal from the switch means, and a minimum value of the reset opeing of the throttle valve means when the engine is returned from the accelerated condition to the idling condition is determined in accordance with the data stored in the memory means.

3. An engine revolution speed control device as set forth in one of claims 1 or 2, wherein the sensor means further includes an actual speed sensor means for providing a speed signal representing an actual engine revolution speed.

4. An engine speed control device for controlling a throttle valve means of an internal combustion engine, the speed control device comprising: means for detecting at least an engine operating temperature, means for controlling a reset position of the throttle valve means of the engine, means for producing a first output signal when a throttle action of the throttle valve means returns under a control of the means for controlling and for producing a second output signal when the throttle action of the throttle valve means is independent of the means for controlling, and means for receiving data from said means for detecting when the second output signal is produced by said means for producing and for operating said means for controlling in such a manner so as to reduce a reset opening of the throttle valve means upon a predetermined variation of data received, whereby the reset opening of the throttle valve means is controlled during a driving operation of the engine thereby preventing an increase in a rotational speed of the engine when the engine returns from an accelerated operation to an idling operation.

5. A method of controlling a rotational speed to control a throttle valve means of an internal combustion engine, the method comprising the steps of:

detecting an actual speed of the internal combustion engine;

detecting at least an operating temperature of the engine;

detecting whether or not a throttle action of the throttle valve means returns under a control of an actuator means for adjusting a reset position of the throttle valve means;

producing a reference speed signal in response to at least the operating temperature of the engine;

comparing the actual speed of the engine with the reference speed signal;

controlling the reset position of the throttle valve means of the engine in accordance with a difference between the actual speed of the engine and the reference speed signal so as to rotate the engine at the reference rotational speed when the throttle action of the throttle valve means returns under the control of the actuator means;

determining the reset position of the throttle valve means of the internal combustion engine in accordance with the engine temperature; and controlling the reset position of the throttle valve means in accordance with the determined reset position when the throttle action of the throttle valve means is independent of the actuator means for reducing a reset opening of the throttle valve means in accordance with at least an increase in the temperature of the engine, thereby preventing the engine rotational speed from increasing above the predetermined rotational speed when the engine returns from the accelerated to an idling condition.

6. An engine revolution speed control device for controlling a throttle valve means of an internal combustion engine, the speed control device comprising:

speed sensor means for detecting a speed signal representing an actual speed of the internal combustion engine;

temperature sensor means for detecting a temperature signal representing the engine temperature;

actuator means for controlling a reset position of the throttle valve means;

means for producing an idling signal when a throttle action of the throttle valve means returns under a control of the actuator means and for producing an acceleration signal when the throttle action of the throttle valve means is independent of the actuator means;

means for controlling the actuator means to adjust the reset position of the throttle valve means;

the actuator control means including reference speed means for producing a reference speed signal having a temperature dependent value in response to the temperature signal of the temperature sensor means;

comparator means for comparing the actual speed signal of the actual speed sensor means with the reference signal of the reference signal producing means;

means for adjusting a reset position of the throttle valve means in response to a differential signal from the comparator means so as to rotate the engine at the reference rotational speed when the means for producing an idling signal produces a signal; and means for reducing a reset opening of the throttle means in response to the increase of the temperature signal of the temperature sensor means when the acceleration signal is produced by the signal producing means, whereby the reset position of the throttle valve means is controlled during a driving operation of the engine to thereby prevent an increase in a rotational speed of the engine when the engine returns from an accelerated operation to an idling operation.

* * * * *